US011148385B2

(12) United States Patent
Marovich et al.

(10) Patent No.: US 11,148,385 B2
(45) Date of Patent: Oct. 19, 2021

(54) INTERCHANGEABLE DIE-CUTTING CREASING SYSTEM

(71) Applicant: Triangle Dies and Supplies, Inc., Batavia, IL (US)

(72) Inventors: Joseph Charles Marovich, Geneva, IL (US); Carl August Duraski, Geneva, IL (US)

(73) Assignee: Triangle Dies and Supplies, Inc., Batavia, IL (US)

( * ) Notice: Subject to any disclaimer, the term of this patent is extended or adjusted under 35 U.S.C. 154(b) by 480 days.

(21) Appl. No.: 15/821,322

(22) Filed: Nov. 22, 2017

(65) Prior Publication Data

US 2018/0147807 A1 May 31, 2018

Related U.S. Application Data

(60) Provisional application No. 62/427,653, filed on Nov. 29, 2016.

(51) Int. Cl.

| | |
|---|---|
| ***B31B 50/25*** | (2017.01) |
| ***B31F 1/10*** | (2006.01) |
| ***B31F 1/08*** | (2006.01) |

(52) U.S. Cl.

CPC ..... *B31B 50/256* (2017.08); *B31F 1/08* (2013.01); *B31F 1/10* (2013.01)

(58) Field of Classification Search

CPC .... B65H 2701/1764; B65H 2701/1766; B65H 2301/42122; B65H 29/14; B31F 1/08; B31F 1/10; B31F 1/07; B31F 1/2822; B31F 1/285; B31F 1/20; B31F 1/22; B31F 1/36; B31F 2201/0753; B31F 2201/0794;

(Continued)

(56) References Cited

U.S. PATENT DOCUMENTS

| | | | | |
|---|---|---|---|---|
| 2,598,649 A * | 5/1952 | Rintoul | B26D 3/085 | 83/663 |
| 2,814,344 A * | 11/1957 | Oberem | B31B 50/00 | 83/693 |
| 3,302,490 A * | 2/1967 | Bishop | B23P 15/406 | 76/107.1 |
| 3,479,931 A * | 11/1969 | Bishop | B26F 1/44 | 493/471 |
| 3,673,926 A | 4/1972 | Saunders | | |

(Continued)

FOREIGN PATENT DOCUMENTS

| | | | |
|---|---|---|---|
| DE | 202011051257 U1 * | 8/2012 | B31F 1/08 |
| DE | 202016102849 U1 * | 6/2016 | B31F 1/08 |
| EP | 2886320 A1 * | 6/2015 | B26F 1/44 |

OTHER PUBLICATIONS

PCT International Search Report, dated Feb. 20, 2018.

*Primary Examiner* — Joshua G Kotis

(74) *Attorney, Agent, or Firm* — Erickson Law Group, PC

(57) ABSTRACT

A cutting-die creasing apparatus includes anchors that together with crease members allow for the quick exchange or replacement of crease members on a die-cutting board. The creasing apparatus does not require fasteners such as nails or staples, nor does it require adhesives or other adherents to attach the crease members to the board and to maintain the structural integrity of the overall system. The creasing apparatus also maintains a more consistent geometric alignment due to the anchor being located via the initial geometrically located cut into the die board as opposed to surface mounted creasing systems, the location of which may vary dependent on how it is applied. The system also provides for a wide variety of designs that can be customized and produced to fit specific applications.

19 Claims, 14 Drawing Sheets

(58) Field of Classification Search
CPC . B31F 2201/0776; B31B 50/02; B31B 50/04; B31B 50/102; B31B 50/14; B31B 50/142; B31B 50/22; B31B 50/741; B31B 50/8126; B31B 50/265; B31B 50/146; B31B 50/25; B31B 50/20; B31B 50/16; B31B 50/252; B31B 50/006; B31B 50/88; B31B 70/00; B31B 70/005; B31B 70/008; B31B 70/18; B31B 70/262; B31B 70/36; B31B 70/62; B31B 70/64; B31B 70/813; B31B 70/146; B31B 70/16; B31B 70/256; B31B 70/266; B31B 70/81; B31B 70/826; B31B 70/83; B31B 70/88; B31B 50/256; B31B 50/592; B31B 50/002; B31B 2110/35; B31B 2100/00; B31D 2205/0052; B31D 3/002; B31D 3/04; B31D 5/0039; B31D 5/0086; B31D 5/02; B31D 5/04; B26D 2007/2607; Y10T 83/9461; Y10T 83/9464; Y10T 83/9457; B26F 2001/4445
USPC ..... 493/463, 468, 471, 473, 475; 83/698.11, 83/698.31, 698.41, 698.42, 698.71, 83/698.91, 699.11
See application file for complete search history.

(56) References Cited

U.S. PATENT DOCUMENTS 3,673,929 A * 7/1972 Saunders ..... B31B 50/00 493/471
3,919,924 A * 11/1975 Snodgrass ..... B31B 50/00 493/405
4,373,929 A 4/1983 Smith
4,808,054 A 2/1989 Cuzin
4,963,062 A * 10/1990 Giannuzzi ..... F16B 19/004 403/408.1
5,194,064 A * 3/1993 Simpson ..... B31B 50/00 493/402
5,221,249 A 6/1993 Simpson
5,409,442 A * 4/1995 Smithwick, Jr. ..... B31F 1/08 493/468
5,647,277 A * 7/1997 DeVito ..... B26D 7/20 101/226
6,071,225 A 6/2000 Kucharski
6,523,448 B1 * 2/2003 Chang ..... B26D 7/025 83/653
7,563,220 B2 * 7/2009 Harris ..... B31F 1/10 493/471

* cited by examiner

INTERCHANGEABLE DIE-CUTTING CREASING SYSTEM

This application claims the benefit of US Provisional application 62/427,653, filed Nov. 29, 2016.

TECHNICAL FIELD

The die-cutting creasing system of the invention relates to die-cutting apparatus, and more specifically relates to a die-cutting creasing apparatus for creasing corrugated sheets of material.

BACKGROUND

Die-cutting apparatus produce product from corrugated sheets of material via forces on a cutting-die that allow a cutting die rule to cut, crease, score, perforate and/or emboss the corrugated sheets. The products produced through this process are called blanks. The blanks are subsequently manipulated in a variety of ways to create boxes, covers, trays, folders, standees (displays), shells, tubes, partitions and interior forms. Some examples of die-cutting apparatus are disclosed in U.S. Pat. Nos. 4,808,054 and 5,409,442, herein incorporated by reference to the extent that these patents are not inconsistent with the present disclosure.

There are generally two types of die-cutting apparatus for corrugated workpieces: flat die-cutting apparatus and rotary die-cutting apparatus. Flat die-cutting apparatus produce blanks by way of a machine press that uses a simultaneous normal force across the entire die. Rotary die-cutting apparatus produce blanks by way of a variety of forces (normal, rotational and tangential). The combination of forces allow for a normal force to dominate and advance across the corrugated board between two opposing cylinders.

The rotary die-cutting apparatus include two revolving cylinders. One cylinder is called a die cylinder upon which the cutting die is mounted. The opposing cylinder is called an anchor cylinder. The surface of the anchor cylinder is usually wrapped completely by a rubber (often polyurethane) sheet referred to as a "blanket." The blanket serves several purposes, one of which is to oppose and cushion the force of the cutting-die rule.

Normally, die-cutting apparatus include a variety of rules that cut, perforate, emboss as well as crease the blank. There are also other items that are attached throughout the die known as "finishing products" that assist in the overall process.

Crease impressions by the die-cutting apparatus allow raw sheets of material to be folded in varying directions and degrees as desired. The quality of the crease impression (sometimes referred to as scoring) is one of the major variables that directly affect the ability to properly stack, store and fold the blank for application. The quality of crease impressions is dependent on the height and cross-sectional profile of the crease member. The crease impression is created by a normal (perpendicular) force upon the corrugated sheet combined with a rotational force (and sometimes a tangential pushing or pulling force) which transfers the corrugated sheet through the process. The crease impression sometimes needs to be altered to produce or maintain a quality blank. It is often the case that to achieve a quality crease impression requires a trial and error type process, which in turn, often requires changing out the crease member profile.

As with most production machinery, downtime can significantly affect the cost of production. The present inventors have recognized that the capability to quickly interchange various crease member designs during production while the die is either mounted to the machine or at the machine location (as opposed to shipping the die to a facility for rework) would greatly benefit the overall flow of production.

Though there are currently a number of systems on the market designed to allow for the interchanging of creasing geometry, most require fasteners, adhesives or other adherents to maintain the structural integrity between the cutting-die board and the crease member.

The present inventors have recognized that fasteners such as staples and nails sometimes complicate systems due to failure of adherence and structural integrity and may create stress concentrations which may adversely affect the alignment and/or structural integrity of the system. The present inventors have recognized that adhesives and other adherents sometimes fail due to the inability to maintain the adherence and may adversely affect downtime due to set-up and hold time.

SUMMARY

The creasing system of the embodiments of the present invention creates effective crease impressions on raw sheets of material. The design also allows for the creation of a variety of profiles of crease members for customized crease profiles. These crease member profiles can be designed and produced in a wide variety of shapes which can be quickly exchanged on the die cutting board.

The creasing system of some of the embodiments of the present invention do not require any other means of maintaining the structural integrity of the system other than the pre-existing static force between the die board and the anchor, and the mating surface between the outer cross-sectional profile of the anchor and the inner cross-sectional profile of the crease member; the combination of which snaps and secures the crease member in place.

The creasing system of some of the embodiments of the present invention do not require fasteners, adhesives or other adherents to install the crease member onto the board. During the die-cutting board construction process, the die-board is prepared to receive the anchor usually via laser burning or jig-cutting lines or slots through the die-board. The anchor, preferably a metallic anchor, is secured to the die-board during the die manufacturing process. The anchor is secured to the die-board by force, usually from pressing or hammering. The width of the laser burn or jig-cut that receives the anchor is slightly thinner than the lower profile width of the anchor so that a static force, gripping or friction, is created and maintained between the anchor and the board.

The upper, outer cross-section of the anchor is exposed above the board and profiled to allow for the securing of the crease member. The inner cross-section of the crease member is profiled in such a way so that it is secured to the exposed profile of the anchor. The crease member is secured to the anchor via a pressing force, pounding force or a sliding force. The mating surfaces between the crease member and the anchor are profiled in such a way as to allow for the removal of the crease member via a pulling force, prying force or sliding force. The crease member may be changed out relatively quickly. The crease member profile can be customized and produced in a wide variety of ways to fit specific applications.

The creasing apparatus according to embodiments of the invention also maintains a more consistent geometric alignment due to the anchor being located via the initial geometrically located cut into the die board as opposed to surface mounted creasing systems, the location of which may vary dependent on how it is applied.

Though the proposed design will be implemented for both flat and rotary die-cutting apparatus, the rotary die-cutting apparatus is slightly more involved and encompasses much of what occurs during the flat die process; therefore the rotary die-cutting apparatus will be referenced throughout the remainder of the description.

Crease impressions assist in the ability to fold raw sheets of material to varying directions and degrees. The crease impression created in a raw sheet of material is dependent on several variables that exist throughout the process. One of the most significant variables in creating quality crease impressions is the outer cross-sectional height and profile of the creasing rule geometry. It is often the case that to achieve a quality crease impression requires a trial and error type process, which in turn, often requires changing out the creasing rule profile. Machine downtime adversely affects the cost of production. The ability to alter or change out the creasing rule geometry in a relatively small amount of time would greatly benefit the overall production process.

The system disclosed herein allows for the changing out of the creasing rule geometry in a relatively short amount of time. The system disclosed herein will allow for the application of an infinite variety of heights and profiles of creasing rule geometry. The specific components of the system is comprised of a die-board, a metallic anchor and the crease disclosed herein. Fasteners such as staples and nails sometimes complicate systems due to failure of adherence and structural integrity and may create stress concentrations which may adversely affect the structural integrity of the system. Adhesives and other adherents sometimes fail due to the inability to maintain the adherence and may adversely affect downtime due to set-up and hold time. Some of the systems disclosed herein are designed in such a way that they do not require fasteners, adhesives or other adherents. During the die-board construction process, the die board is prepared to receive the metallic anchor usually via laser burning or jig-cutting through the die-board. The metallic anchor is secured to the die-board during the die manufacturing process. The metallic anchor is secured to the die-board by force, usually from pressing or hammering. The width of the laser burn or jig-cut that receives the metallic anchor is slightly thinner than the lower profile width of the metallic anchor so that a static force is created and maintained between the metallic anchor and the board. The upper, outer cross-section of the metallic anchor is exposed above the board and profiled to allow for the securing of the crease disclosed herein.

The inner cross-section of the crease disclosed herein is profiled in such a way so that it is secured to the exposed profile of the metallic anchor. The crease rule is secured to the metallic anchor via a pressing force, pounding force or a sliding force. The mating surfaces between the crease disclosed herein and the metallic anchor are profiled in such a way as to allow for the removal of the crease disclosed herein via a pulling force, prying force or sliding force. The crease disclosed herein may be changed out relatively quickly. The crease profile of the crease disclosed herein can be customized and produced in an infinite amount of ways to fit specific desires.

Other than crease profiles, the specific system of adherence to the board can apply to alternative purposes and pieces that are part of the die board but have different functions other than forming creases in the corrugation. These purposes include, but are not limited to rubber, foam and embossing placement and processes.

Numerous other advantages and features of the present invention will become readily apparent from the following detailed description of the invention and the embodiments thereof, from the claims and from the accompanying drawings.

DETAILED DESCRIPTION

Figure 1:
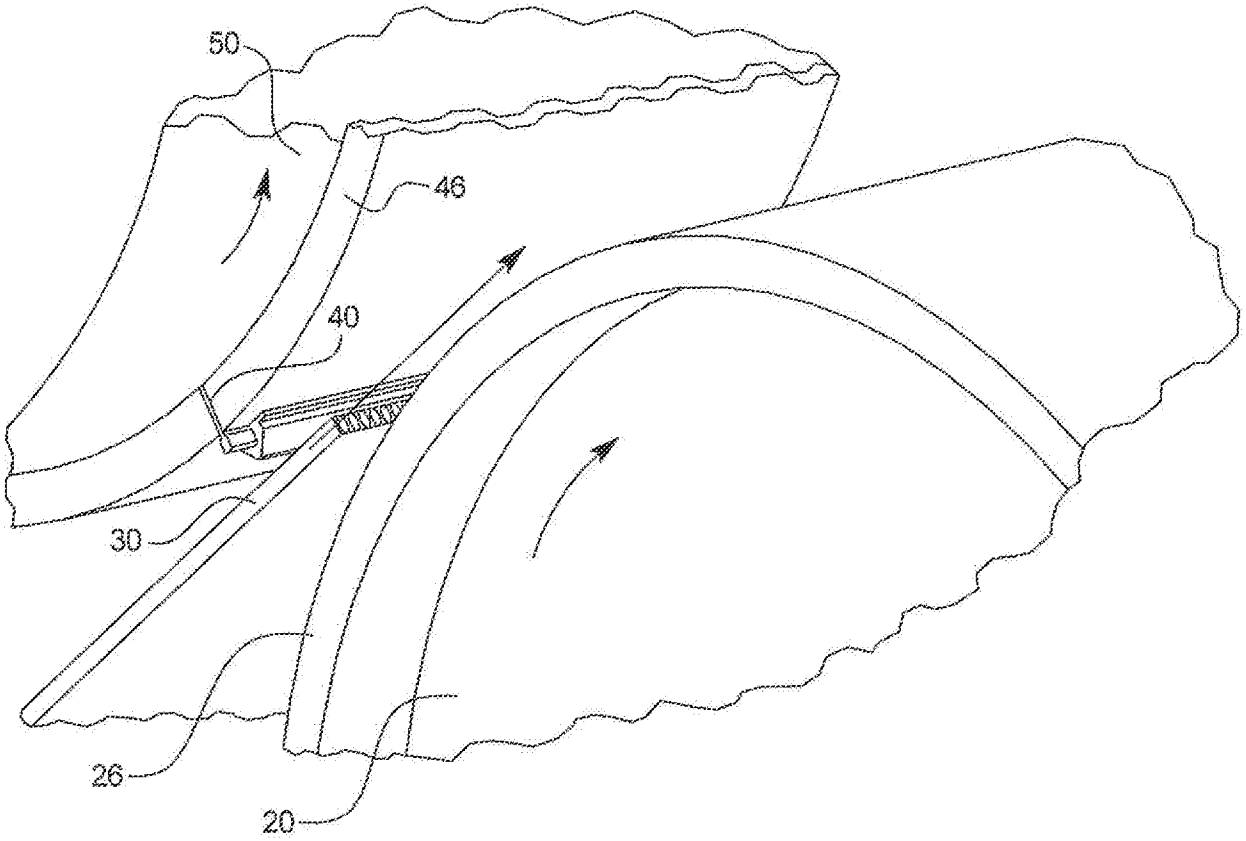
FIG. 1 is a fragmentary perspective view of a die-cutting system according to the embodiments of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference US Provisional application 62/427,653, filed Nov. 29, 2016.

FIG. 1 is a simplistic view of a creasing system according to an embodiment of the invention. The system includes an anchor cylinder 20, an anchor blanket 26, and the raw sheet of material 30, such as corrugated cardboard stock, from which the blank is created. The driving force for the entire rotary die process that creates the blank is usually a motor which directly spins the die board cylinder 50 upon which the die-board 46 is fastened and indirectly spins the anchor cylinder 20 via a system of gears from the die-board cylinder in the direction indicated by the arrows. The raw sheet of material 30 is fed between the cylinders 20, 50 normally via a feeder (not shown). The rotational direction and motion of the cylinders grab the raw sheet of material. Various forces (normal, rotational and tangential) are imparted on the raw sheet of material as it travels between the cylinder creates the blank. Once the full blank is created, it is either stacked or conveyed further down the processing line.

Figure 2:
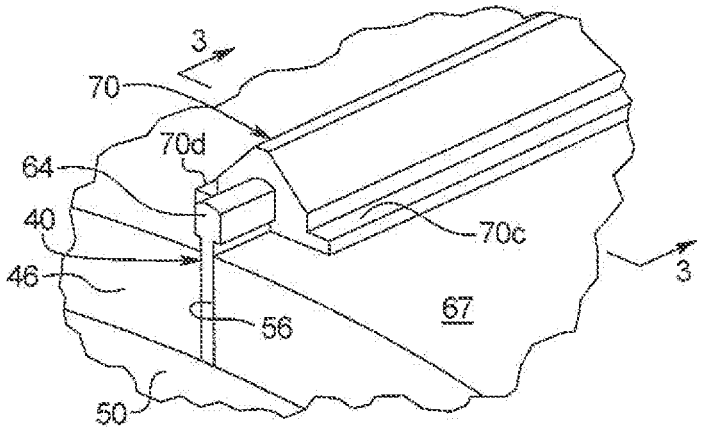
FIG. 2 is an enlarged, fragmentary perspective view taken from FIG. 1.
Figure 3:
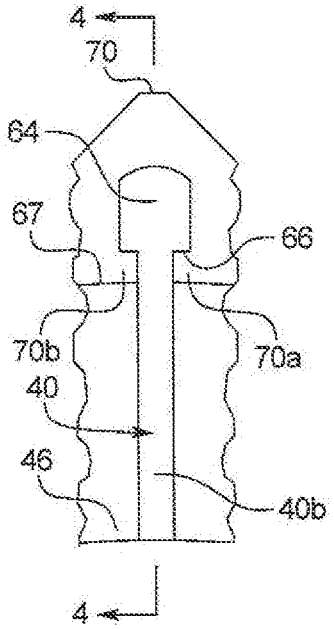
FIG. 3 is a fragmentary sectional view taken generally along line 3-3 of FIG. 2.

FIGS. 2-3 show an assembly view of an anchor 40, a crease member 70 (described below), and the die-cutting board 46, all mounted on the cylinder 50.

Figure 4:
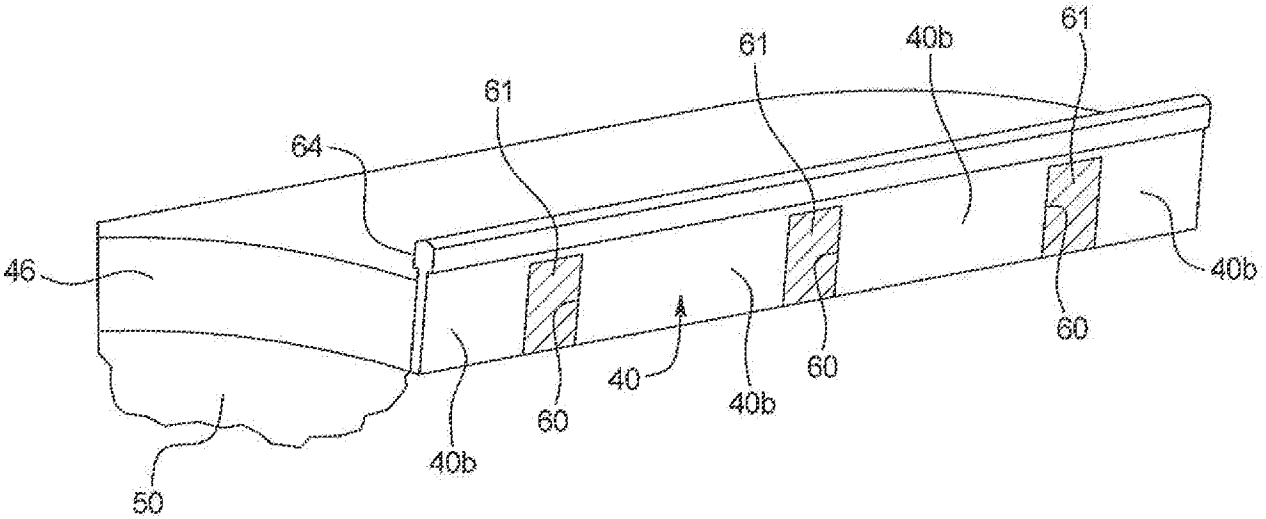
FIG. 4 is a fragmentary sectional view taken generally along lines 4-4 of FIG. 3 with the crease member removed.

FIG. 4 shows the anchor 40 mounted to the die-cutting board without the crease member installed. The anchor is preferably a metallic anchor.

Figure 3A:
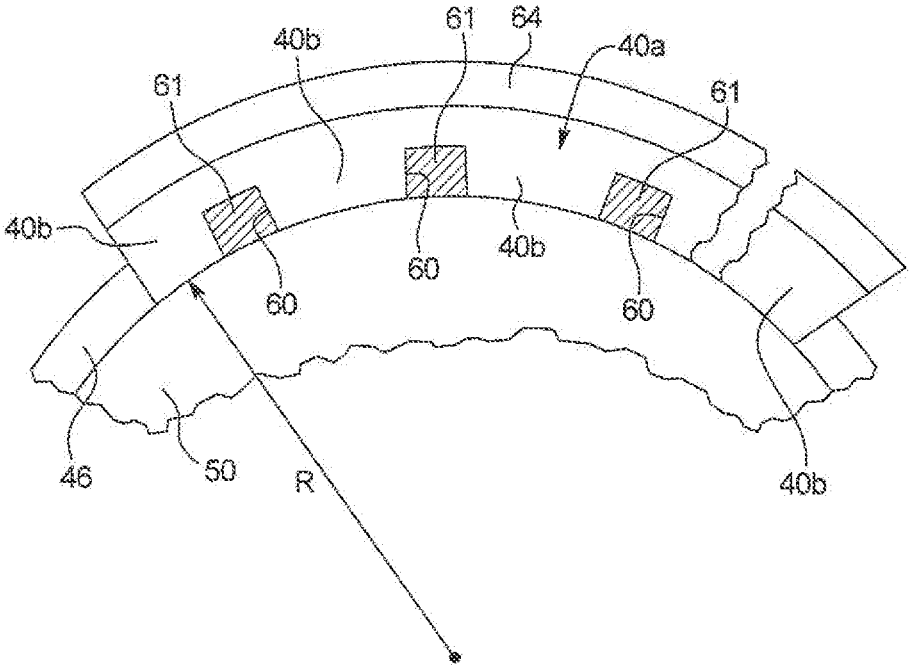
FIG. 3A is a fragmentary sectional view showing an anchor member for being installed in a circumferential direction along the die board.

FIGS. 2-3 and 4 show the creasing system applied substantially parallel to the cylinder 50 axis. The system also applies to the direction perpendicular to the cylinder axis and all directions in between. As shown in FIG. 3A, in the perpendicular direction, or circumferential to the die board, an anchor 40*a* has an arc shape whose radius R at its base equals that of the die-board 46 inside radius.

The anchor 40 or 40*a* is secured to the die-board by static forces created when a lower body portion 40b of the anchor is forced into the laser or jig cut lines or slots 56 which are precut into the board 46. Gaps 60 are cut into the lower body portion 40*b* of the anchor 40, 40*a* and the locations of the gaps 60 correspond to segments along the lines 56 that are not cut into the die-board. These segments form solid bridges 61 in the board 46 allow for the die-board to maintain enough structural integrity about the anchor to keep the die-board together while still allowing for the static force to secure the anchor 40, 40*a* into the board 46.

The anchor 40, 40*a* includes an enlarged head rail 64 located above the upper surface 67 of the board 46. The head rail 64 provides shoulders 66 that are spaced above the upper surface 67 of the board 46. A crease member 70 is mounted onto the head rail 64 and includes inwardly turned lip portions 70a, 70b that underlie the shoulders 66 and are gripped between the upper surface 67 and the shoulders 66. The crease member 70 shown in FIGS. 1-3 has a triangular profile with lateral flat base members 70*c*, 70*d* that press against the surface 67 when the crease member 70 is snap installed onto the anchor 40, 40*a*.

FIGS. 5-10 illustrate different crease members which can be mounted to the anchor according to various embodiments of the invention.

Figure 5:
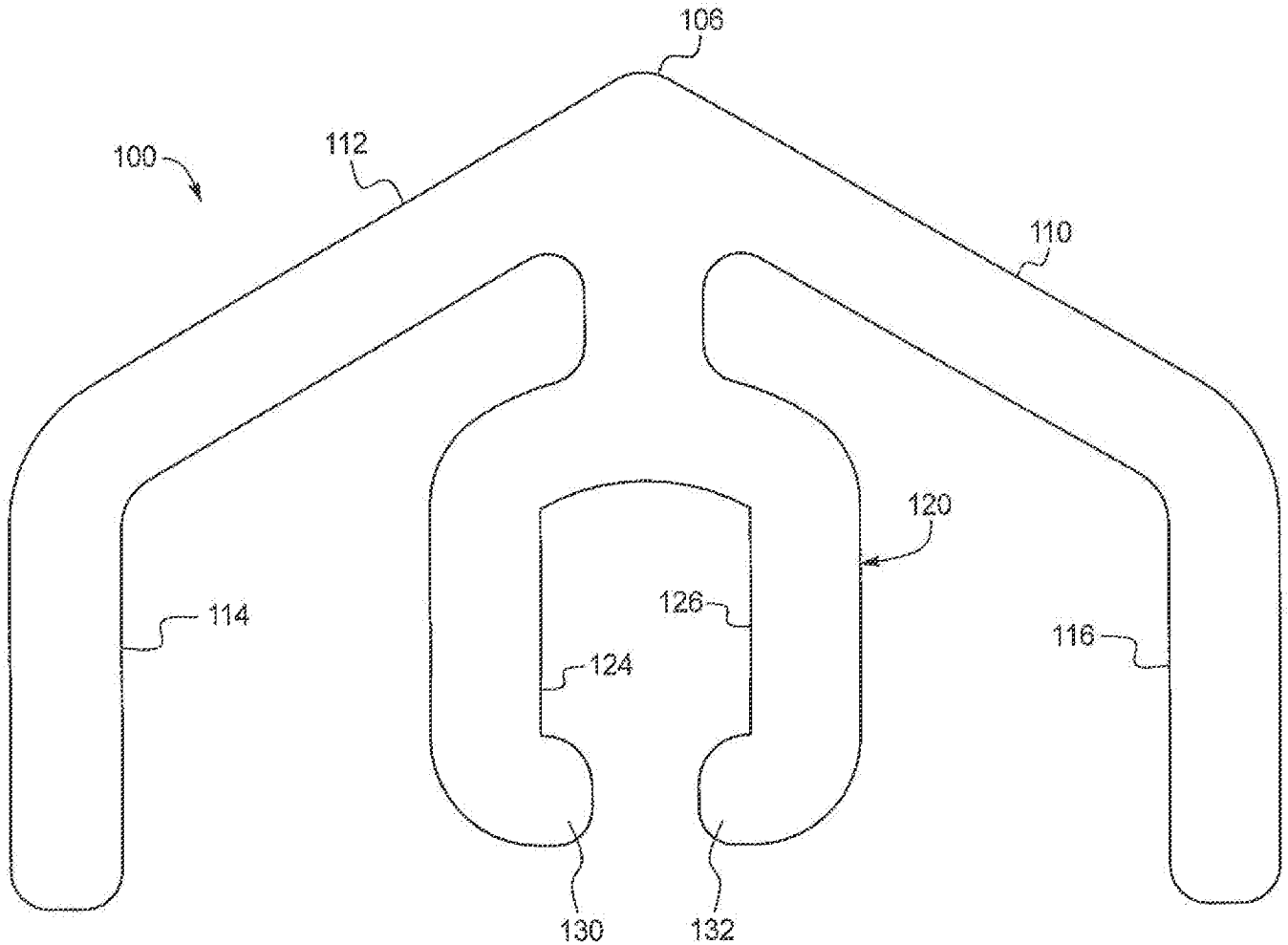
FIG. 5 is an end view of a further embodiment crease member profile according to the invention.

FIG. 5 illustrates a crease member 100 that is configured to mount to the anchor. This crease member 100 includes a ridge 106 formed by angular walls 110, 112 that angle into substantially parallel walls 114, 116. The ridge 106 is connected on a back side into a mounting clasp 120 that resiliently clamps onto the anchor. The clasp 120 includes substantially parallel walls 124, 126 having inward turned lip portions 130, 132 used to underlie the anchor head. When the crease member is installed onto the anchor, the clasp 120 grips the anchor and the walls 114, 116 press against the surface of the die board. The walls 114, 116 can resiliently deflect outwardly to hold the crease member 100 to the anchor securely in a resilient fashion.

Figure 6:
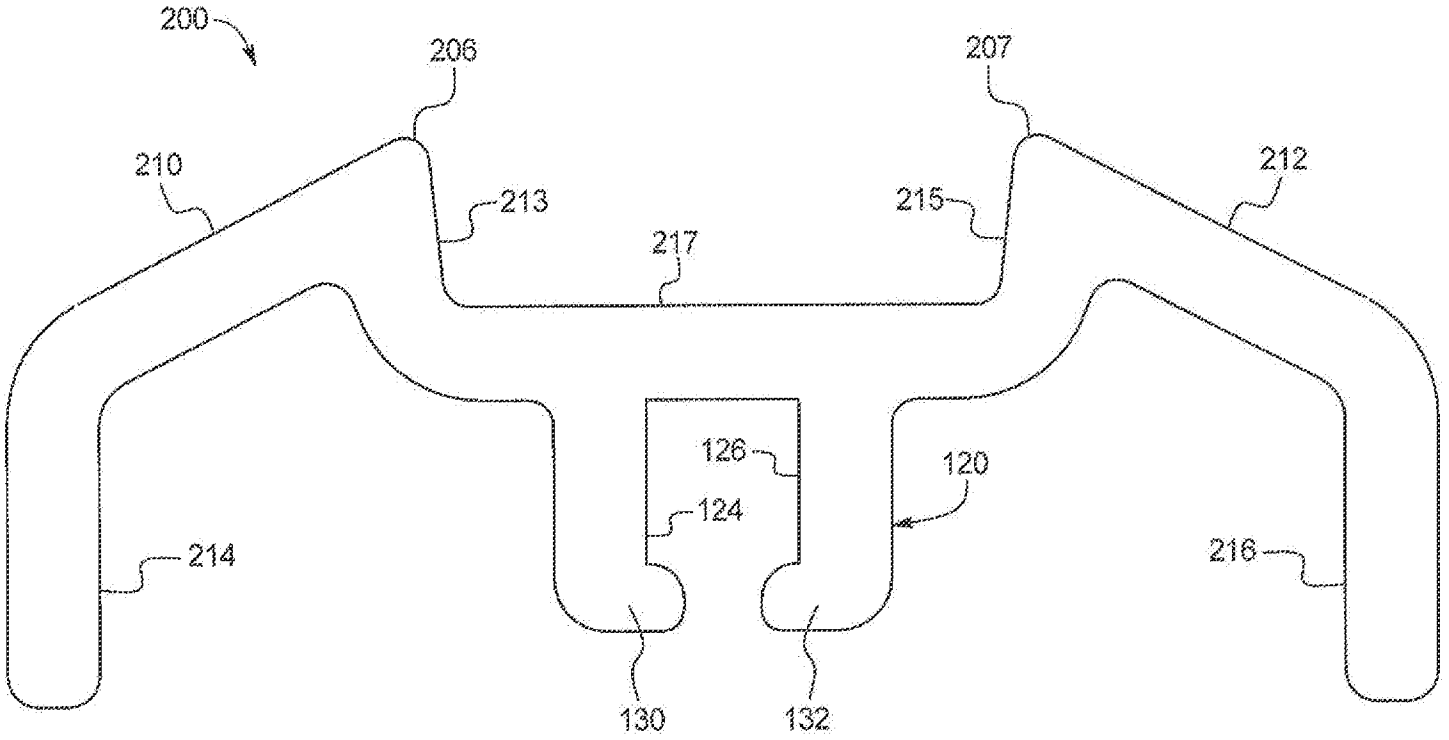
FIG. 6 is an end view of a further embodiment crease member profile according to the invention.

FIG. 6 illustrates a crease member 200 that is configured to mount to the anchor. This crease member 200 includes substantially parallel ridges 206, 207 formed by angular walls 210, 212 that angle into substantially parallel walls 213, 215. The substantially parallel walls 213, 215 are connected on a back side into a flat wall 217 formed with a mounting clasp 120 that resiliently clamps onto the anchor. The clasp 120 includes substantially parallel walls 124, 126 having inward turned lip portions 130, 132 used to underlie the anchor head. The angular walls are angled into substantially parallel walls 214, 216. When the crease member is installed onto the anchor, the clasp 120 grips the anchor and the walls 214, 216 press against the surface of the die board. The walls 214, 216 can resiliently deflect outwardly to hold the crease member 200 to the anchor securely in a resilient fashion.

Figure 7:
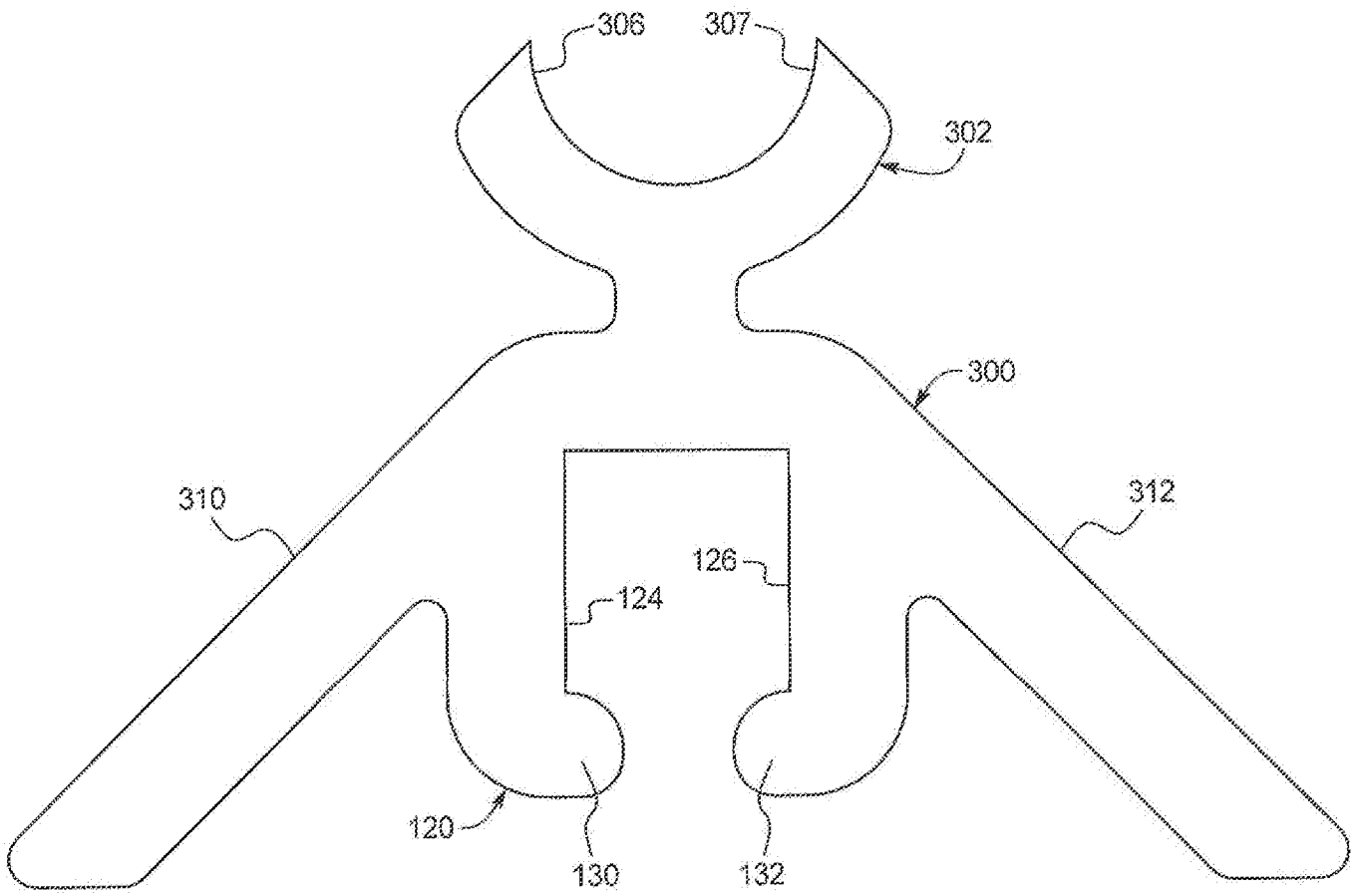
FIG. 7 is an end view of a further embodiment crease member profile according to the invention.

FIG. 7 illustrates a crease member 300 that is configured to mount to the anchor. This crease member 300 includes a raised C-shaped wall 302 forming substantially parallel ridges 306, 307. The C-shaped wall 302 is connected to an intersection of angular walls 310, 312. The C-shaped wall 302 is connected on a back side into a mounting clasp 120 that resiliently clamps onto the anchor. The clasp 120 includes substantially parallel walls 124, 126 having inward turned lip portions 130, 132 used to underlie the anchor head. When the crease member is installed onto the anchor, the clasp 120 grips the anchor and the walls 310, 312 press against the surface of the die board. The walls 310, 312 can resiliently deflect outwardly to hold the crease member 300 to the anchor securely in a resilient fashion.

Figure 8:
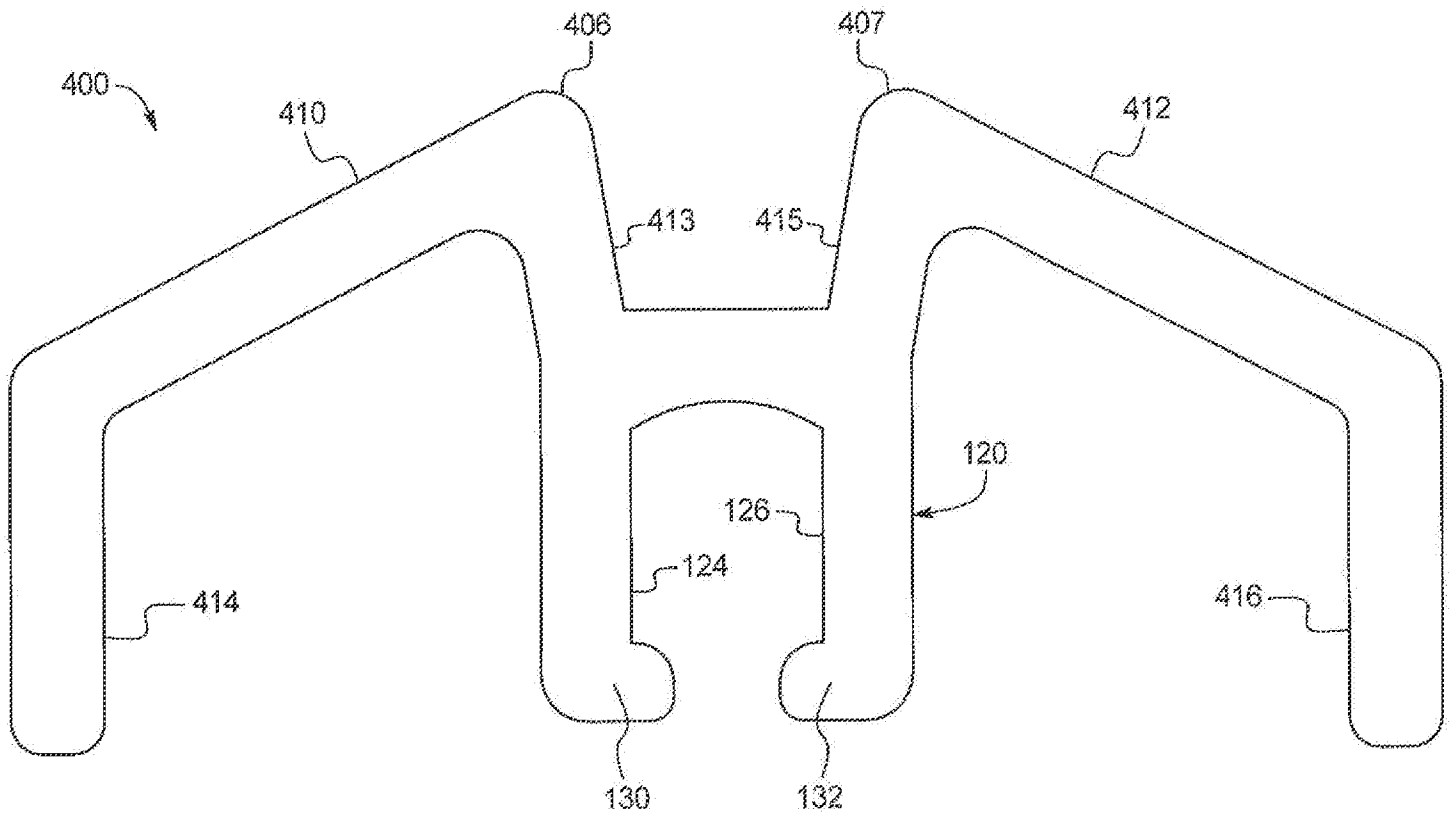
FIG. 8 is an end view of a further embodiment crease member profile according to the invention.

FIG. 8 illustrates a crease member 400 that is configured to mount to the anchor. This crease member 400 includes substantially parallel ridges 406, 407 formed by angular walls 410, 412 that angle into substantially parallel walls 413, 415. The ridge 106 is connected on a back side into a mounting clasp 120 that resiliently clamps onto the anchor. The clasp 120 includes substantially parallel walls 124, 126 having inward turned lip portions 130, 132 used to underlie the anchor head. The angular walls 410, 412 are angled into substantially parallel walls 414, 416. When the crease member is installed onto the anchor, the clasp 120 grips the anchor and the walls 414, 416 press against the surface of the die board. The walls 414, 416 can resiliently deflect outwardly to hold the crease member 400 to the anchor securely in a resilient fashion.

Figure 9:
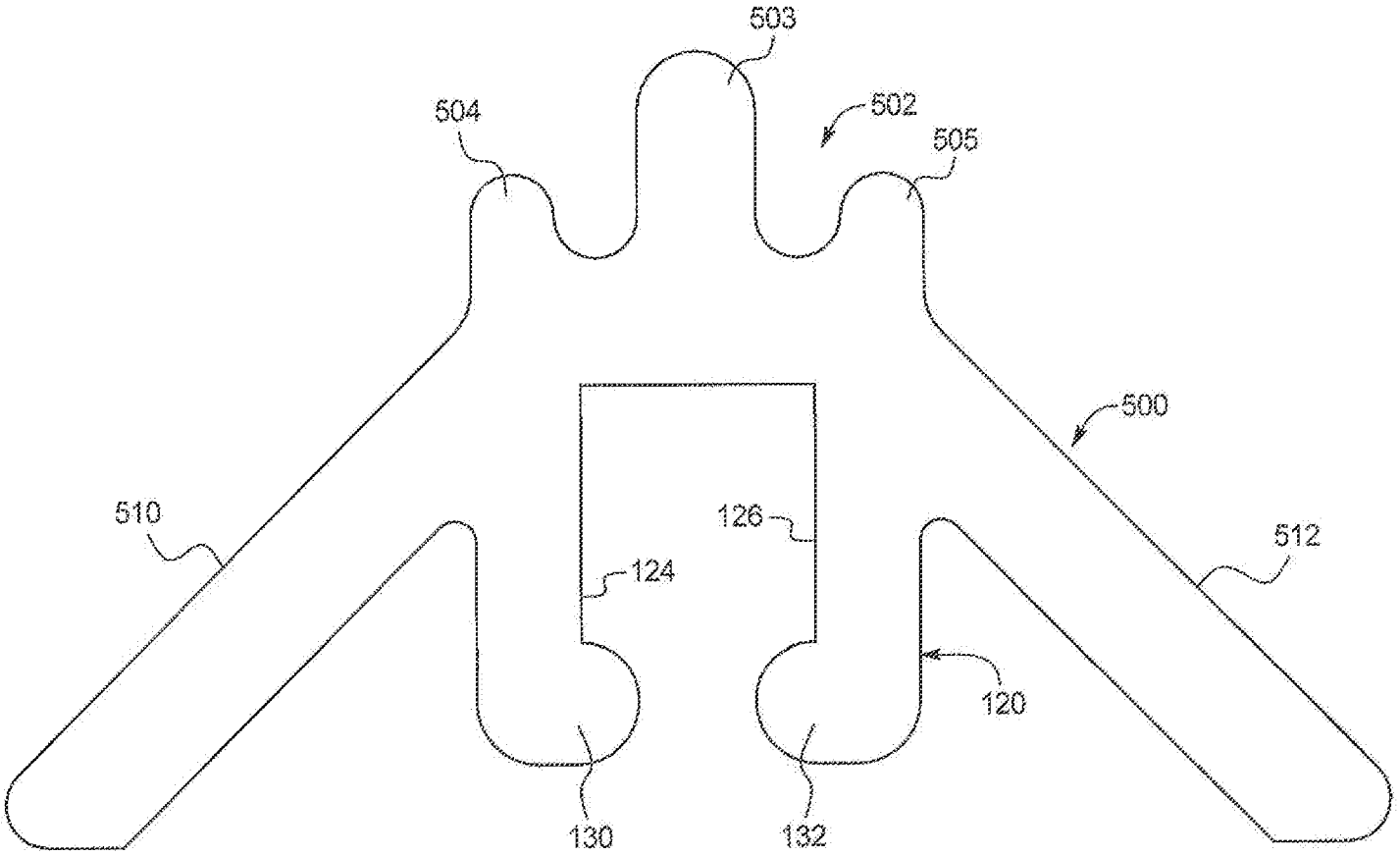
FIG. 9 is an end view of a further embodiment crease member profile according to the invention.

FIG. 9 illustrates a crease member 500 that is configured to mount to the anchor. This crease member 500 includes a three ridge formation 502, including a primary ridge 503 and two secondary ridges 504, 505 straddling the primary ridge 503. The three ridge formation 502 is formed with angular walls 510, 512. The three ridge formation 502 is connected on a back side into a mounting clasp 120 that resiliently clamps onto the anchor. The clasp 120 includes substantially parallel walls 124, 126 having inward turned lip portions 130, 132 used to underlie the anchor head. When the crease member is installed onto the anchor, the clasp 120 grips the anchor and the walls 510, 512 press against the surface of the die board. The walls 510, 512 can resiliently deflect outwardly to hold the crease member 500 to the anchor securely in a resilient fashion.

Figure 10:
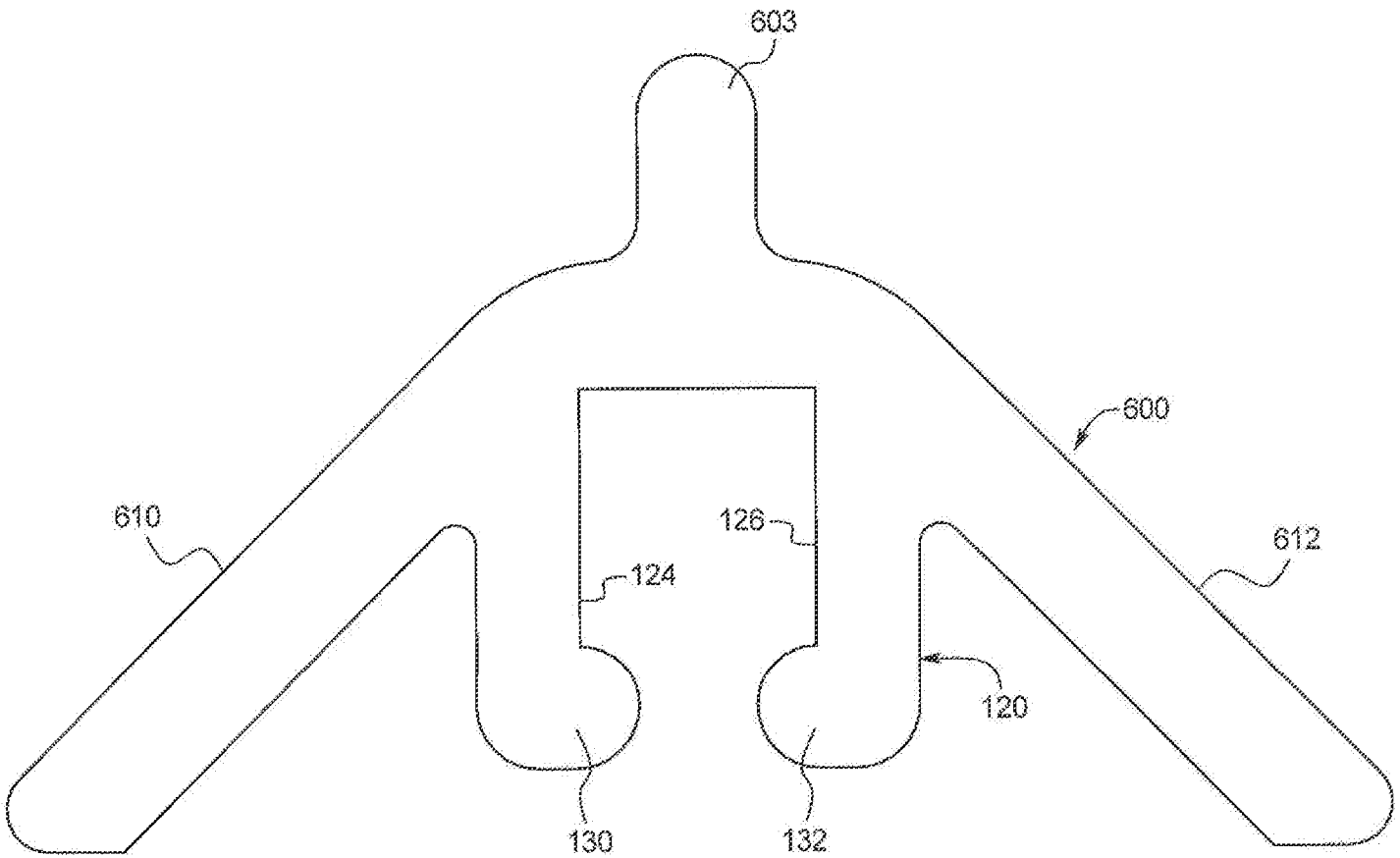
FIG. 10 is an end view of a further embodiment crease member profile according to the invention.

FIG. 10 illustrates a crease member 600 that is configured to mount to the anchor. This crease member 600 includes an upstanding ridge 603. The upstanding ridge 603 is formed with angular walls 610, 612. The upstanding ridge 603 is connected on a back side into a mounting clasp 120 that resiliently clamps onto the anchor. The clasp 120 includes substantially parallel walls 124, 126 having inward turned lip portions 130, 132 used to underlie the anchor head. When the crease member is installed onto the anchor, the clasp 120 grips the anchor and the walls 610, 612 press against the surface of the die board. The walls 610, 612 can resiliently deflect outwardly to hold the crease member 600 to the anchor securely in a resilient fashion.

Figure 11:
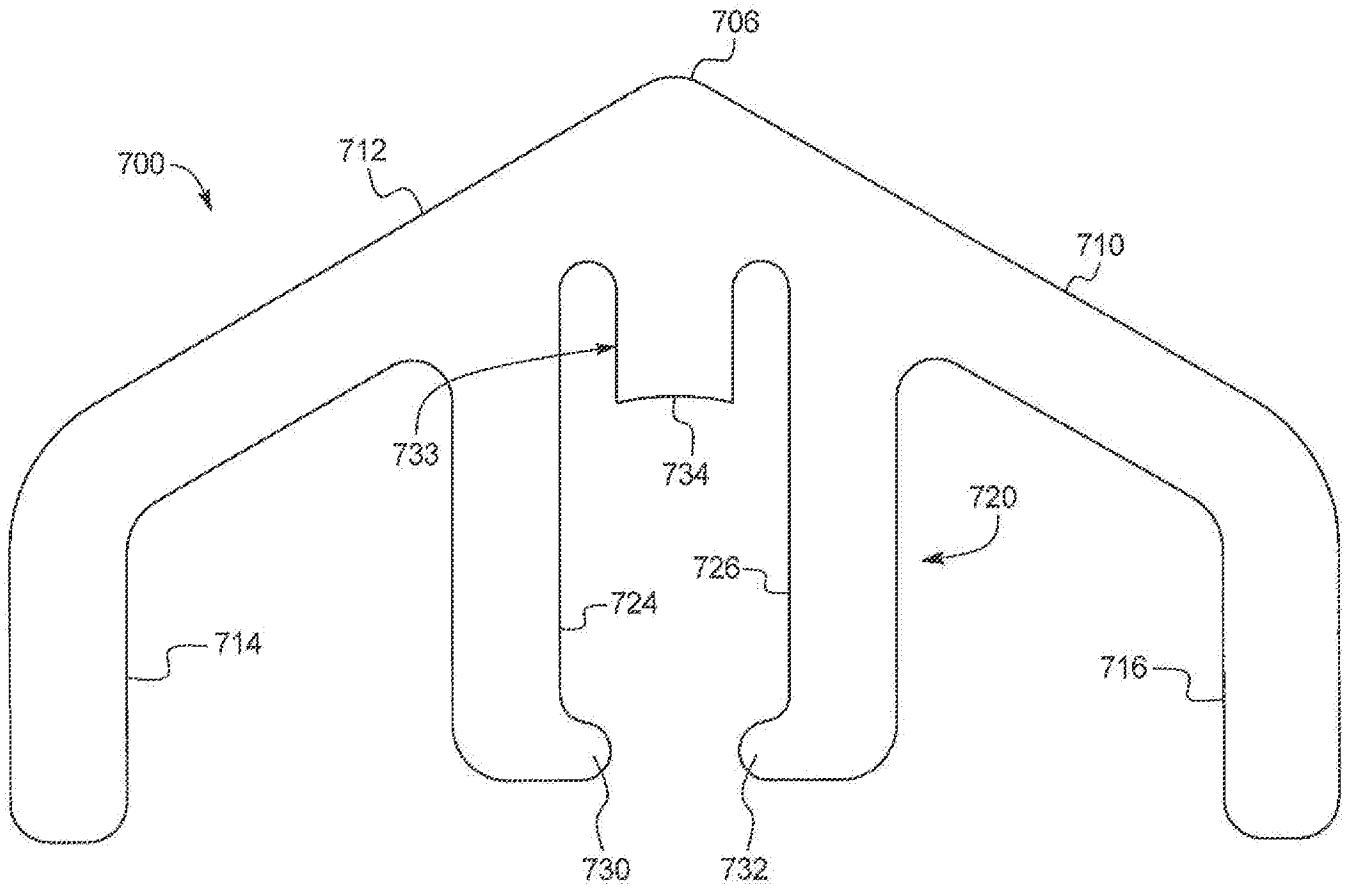
FIG. 11 is an end view of a further embodiment crease member profile according to the invention.

FIG. 11 illustrates a crease member 700 that is configured to mount to the anchor. This crease member 700 includes a ridge 706 formed by angular walls 710, 712 that angle into substantially parallel walls 714, 716. The ridge 706 is connected on a back side into a mounting clasp 720 that resiliently clamps onto the anchor. The clasp 720 includes substantially parallel walls 724, 726 having inward turned lip portions 730, 732 used to underlie the anchor head. The clasp 720 also includes a center wall 733 having a concave face 734 for pressing against the anchor head. When the crease member is installed onto the anchor, the clasp 720 grips the anchor and the walls 714, 716 press against the surface of the die board. The walls 714, 716 can resiliently deflect outwardly to hold the crease member 700 to the anchor securely in a resilient fashion.

Figure 11A:
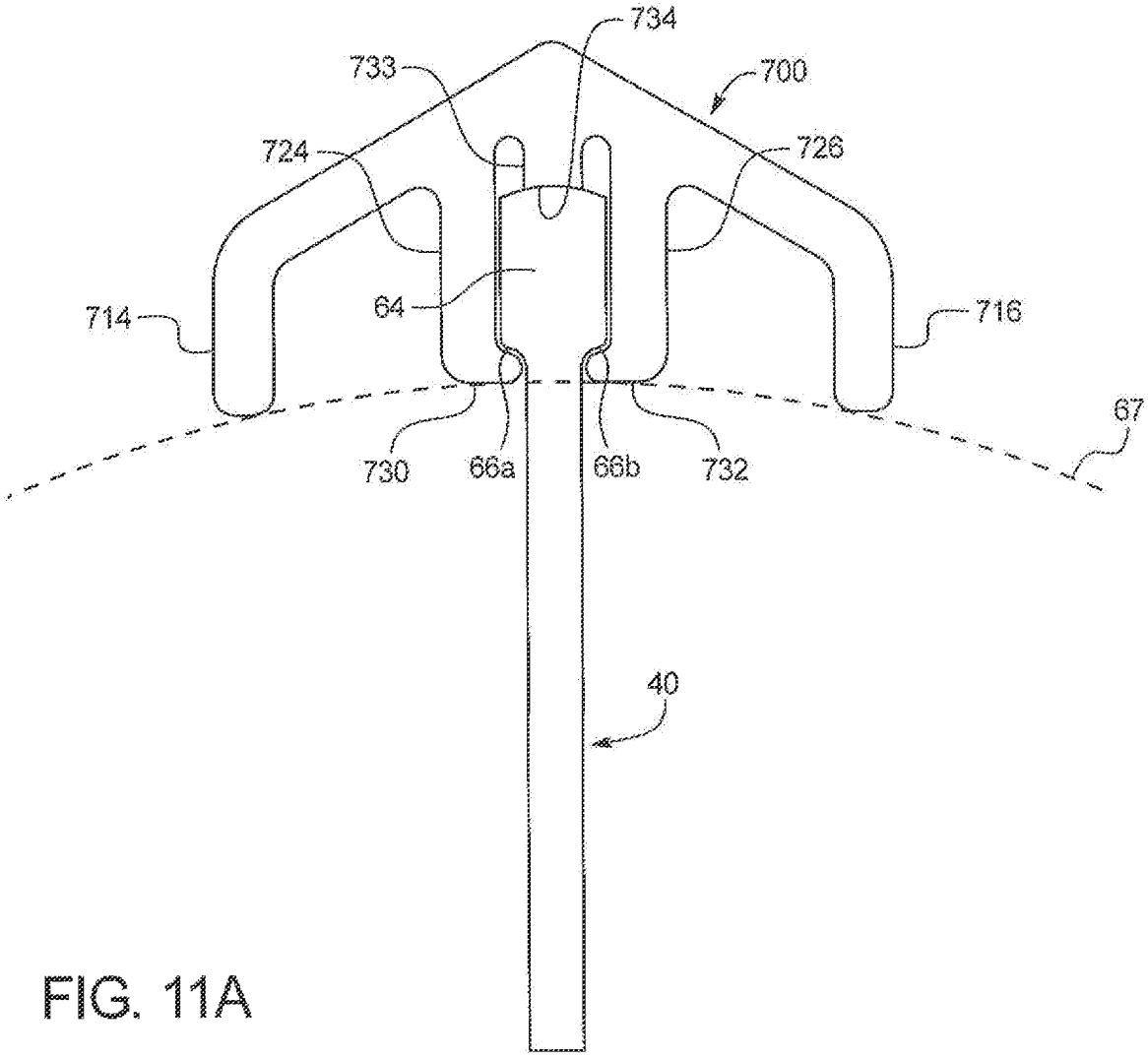
FIG. 11A is an end view of the crease member of FIG. 11 showing the crease member installed on an anchor.

FIG. 11A illustrates one way in which the crease m ember 700 is held onto the anchor 40. When the crease member is snapped down onto the anchor member and the head rail thereof, substantially parallel walls 714, 716 press against the upper surface 67 of the board 46 and can resiliently flex slightly outwardly with respect to the anchor. This causes a resilient force upward by the lip portions 730, 732 on the shoulders 66*a*, 66*b* of the anchor rail. This resilient force created by the outer legs and the lip portions against the anchor head rail can be present in all of the embodiments described herein. Additionally, there can be a resilient clamping force on the anchor head by the lip portions 730, 732 and the center wall 733.

Figure 12:
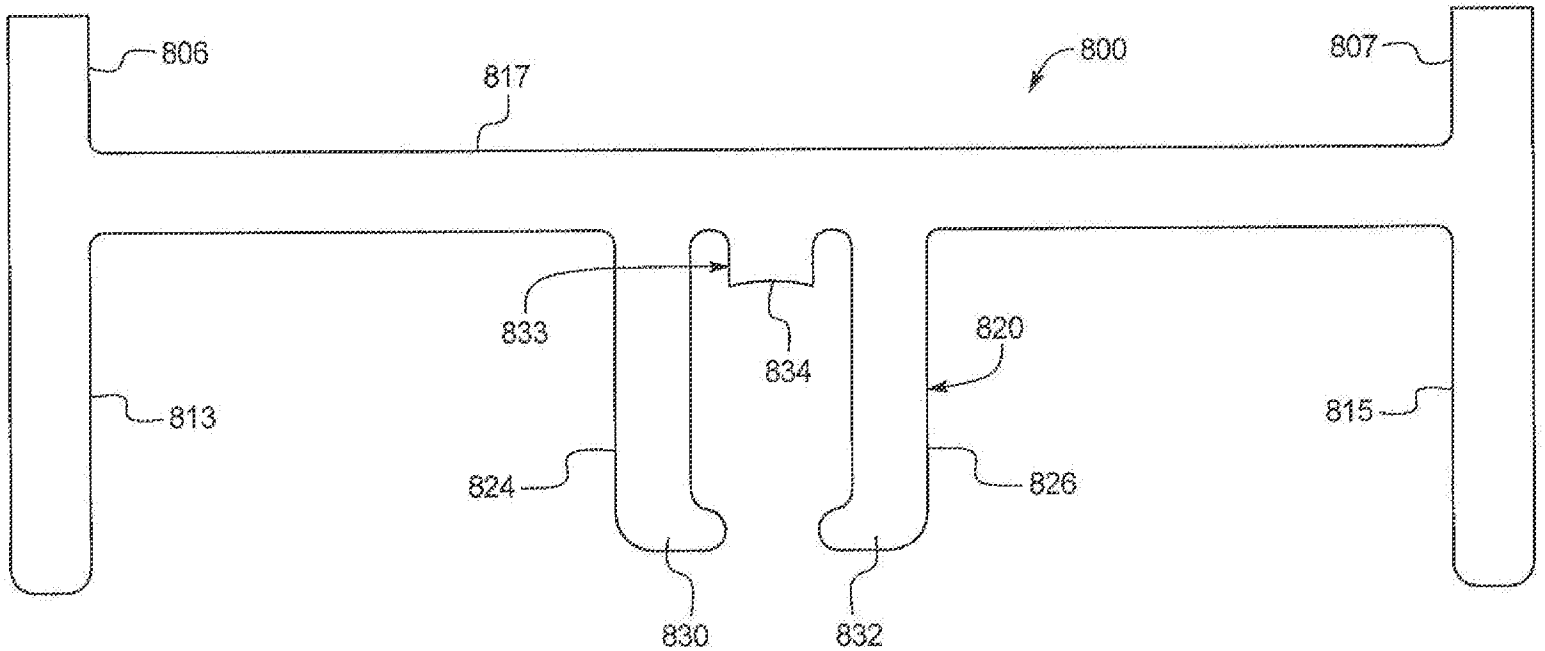
FIG. 12 is an end view of a further embodiment crease member profile according to the invention.

FIG. 12 illustrates a crease member 800 that is configured to mount to the anchor. This crease member 800 includes substantially parallel walls 806, 807 for forming reverse folds, which extend into lower substantially parallel walls 813, 815. The substantially parallel walls 813, 815 are connected on a top end by a flat wall 817 formed with a mounting clasp 820 that resiliently clamps onto the anchor. The clasp 820 includes substantially parallel walls 824, 826 having inward turned lip portions 830, 832 used to underlie the anchor head. The clasp 820 also includes a center wall 833 having a concave face 834 for pressing against the anchor head. When the crease member is installed onto the anchor, the clasp 820 grips the anchor and the walls 813, 815 press against the surface of the die board. The walls 813, 815 can resiliently deflect outwardly to hold the crease member 800 to the anchor securely in a resilient fashion.

Figure 13:
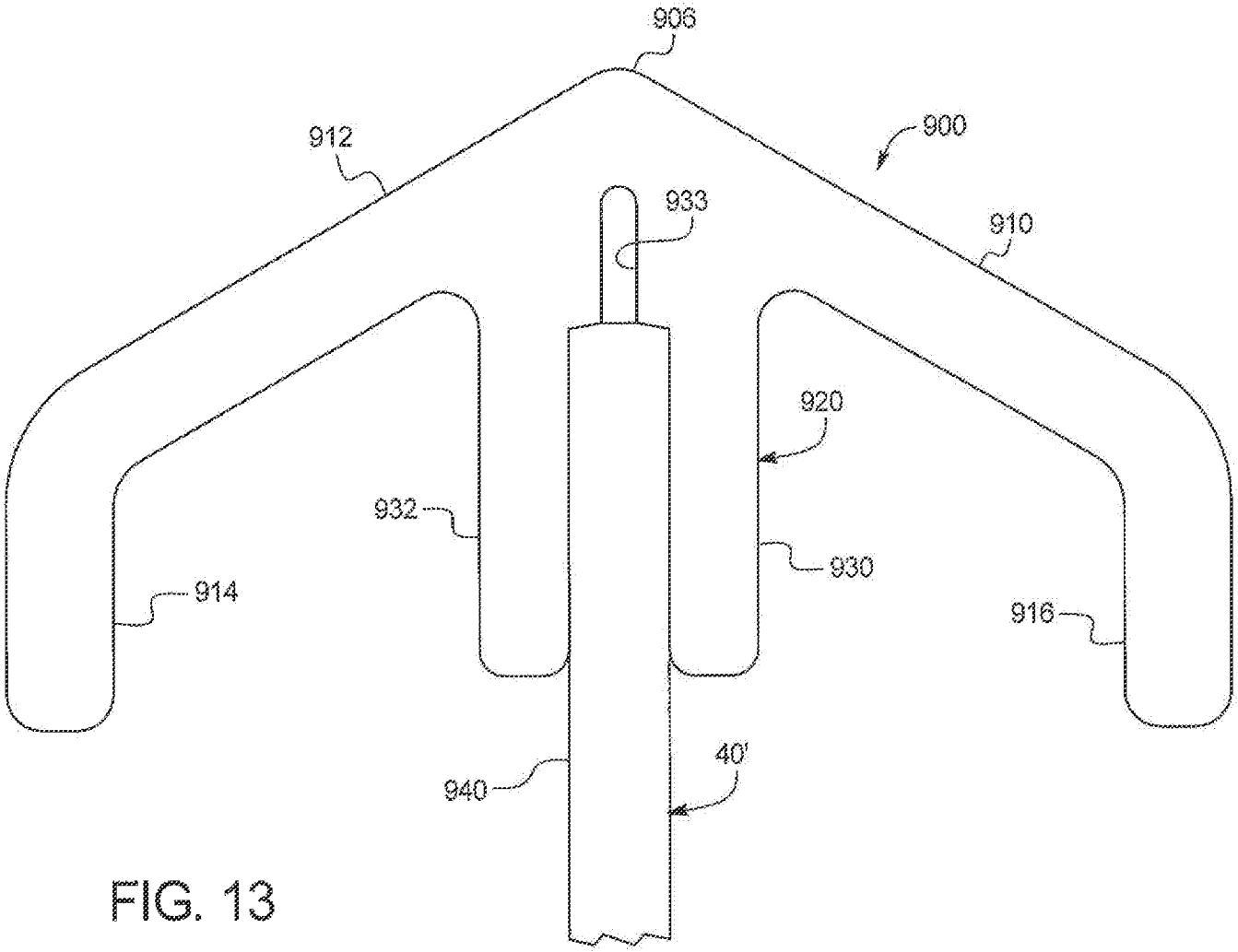
FIG. 13 is an end view of a further embodiment crease member installed on an anchor.

FIG. 13 illustrates a crease member 900 that is configured to mount to a modified anchor 40'. This crease member 900 includes a ridge 906 formed by angular walls 910, 912 that angle into substantially parallel walls 914, 916. The ridge 906 is connected on a back side into a mounting clasp 920 formed by substantially parallel walls 930, 932 that resiliently clamp onto the anchor. The clasp 920 includes a vertical slot 933 that adds flexibility to the spreading movement of the walls 930, 932. In this embodiment the anchor is configured as a straight wall 940 without an anchor head rail. When the crease member is installed onto the anchor, the clasp 920 resiliently grips the wall 940 between the walls 930, 932. The wall 940 slightly and resiliently spreads the walls 930, 932 causing a friction fit. The walls 914, 916 press against the surface of the die board when the crease is installed onto the anchor.

Figure 14:
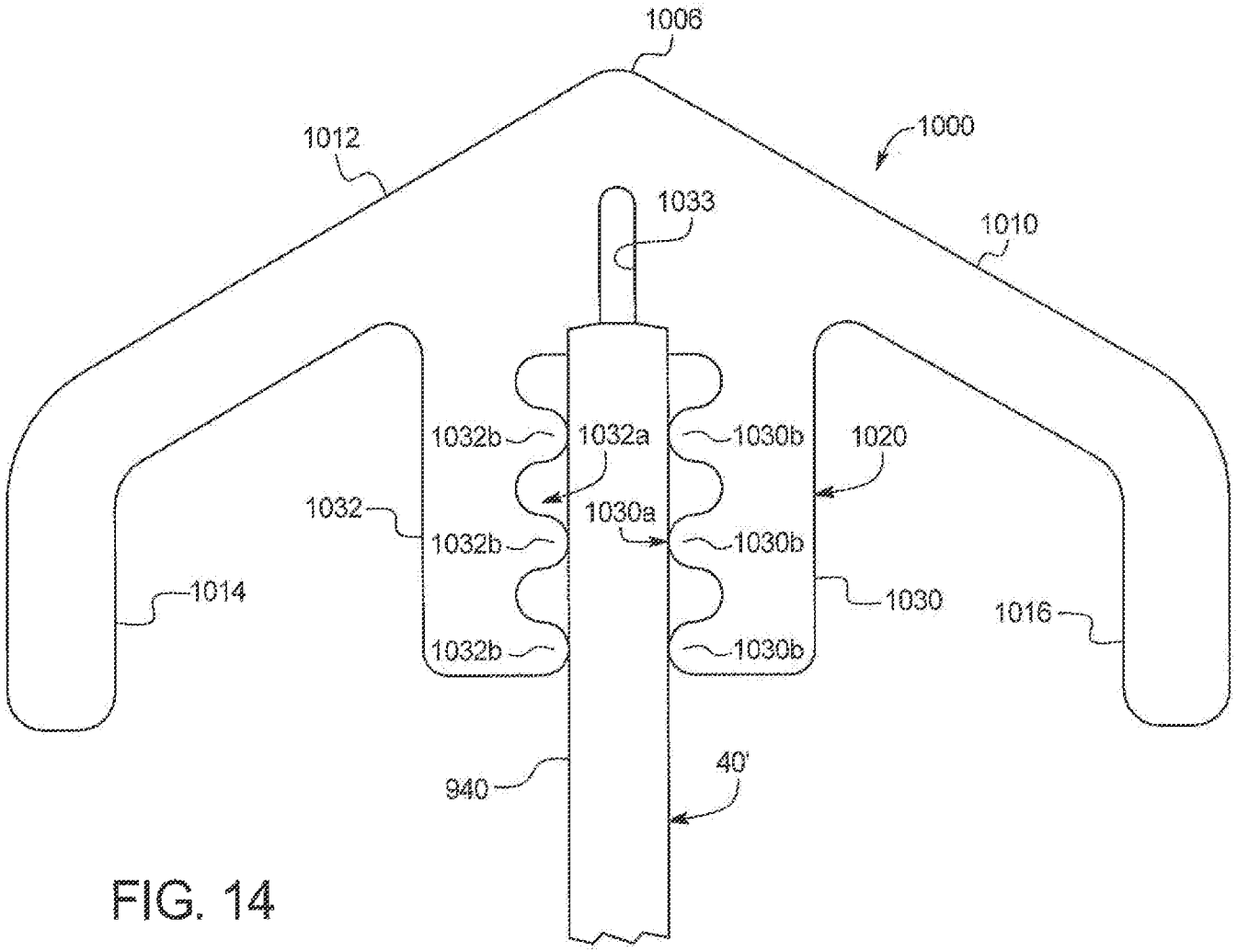
FIG. 14 is an end view of a further embodiment crease member installed on an anchor.

FIG. 14 illustrates a crease member 1000 that is configured to mount to the modified anchor 40'. This crease member 1000 includes a ridge 1006 formed by angular walls 1010, 1012 that angle into substantially parallel walls 1014, 1016. The ridge 1006 is connected on a back side into a mounting clasp 1020 formed by substantially parallel walls 1030, 1032 that resiliently clamp onto the anchor. The clasp 1020 includes a vertical slot 1033 that adds flexibility to the spreading movement of the walls 1030, 1032.The walls 1030, 1032 include an undulating profile 1030*a*, 1032*a* respectively with parallel rounded ridges 1030*b*, 1032*b* respectively. In this embodiment the anchor 40' is configured as the straight wall 940 without an anchor head rail. When the crease member is installed onto the anchor, the clasp 1020 resiliently grips the wall 940 between the walls 1030, 1032. The wall 940 slightly and resiliently spreads the walls 1030, 1032 causing a friction fit. The undulating profiles 1030*a*, 1032*a* increase the frictional engagement between the walls 1030, 1032 and the wall 940. The walls 1014, 1016 press against the surface of the die board when the crease is installed onto the anchor.

The use of a resilient gripping of the walls 930, 932 of an anchor wall 940, or the walls 1030, 1032 with undulating inside surfaces are techniques that could be used on any of the embodiments described herein. The walls 124, 126 of the clasps 120 shown in FIGS. 5-10 could be configured to grip the anchor head rail by resiliently clamping toward each other onto the sides of the head rail, in addition to, or instead of, the other provisions for holding the crease member onto the head rail, such as the inwardly turned lip portions 130, 132.

The crease member 70, 100, 200, 300, 400, 500, 600, 700, 800, 900, and 1000 described herein are preferably composed of a plastic or other polymer material, such as a polymer resin, such as a Rigid Polyvinyl Chloride (RPVC). Other materials may be possible, such as a powdered metal. It may also be possible to co-extrude two different polymer resins to produce the crease member.

The crease members and anchors shown in FIGS. 13 and 14 are installed as a compression or adherence fit. To enhance the engagement of the crease member and the anchor an adhesive can be used between the walls 930, 932 and the wall 940; and between the walls 1030, 1032 and the wall 940. It is possible only a weak adhesive would suffice.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A creasing apparatus comprising:

a die mounting board having a slot cut therein;

an anchor having a body portion fixed within the slot and a head rail portion extending above the mounting board, wherein the slot extends throughout a thickness of the die mounting board and the body portion extends through the slot;

a crease member having an upper part for impacting a workpiece and a lower part having a formation shaped to removably engage the head rail portion of the anchor, and also having walls extending outward from the lower part and toward the die mounting board, the walls pressed against the die mounting board when the crease member is engaged with the head rail portion;

wherein the crease member formation includes lip portions and the head rail of the anchor has shoulders elevated above a top surface of the die mounting board, and when the crease member and the anchor are engaged, the lip portions underlie the shoulders to snap the crease member into engagement with the anchor;

wherein the lip portions are forced against an under surface of the shoulders by a reaction force on the walls by the top surface of the die mounting board.

2. The creasing apparatus according to claim 1, wherein the body portion includes gaps and the slot includes discontinuities corresponding in position to the gaps, such that the body portion fits within the slots but not in the discontinuities.

3. The creasing apparatus according to claim 2, wherein the mounting board is in the form of a cylinder and is fit over a die cylinder that is driven in rotation.

4. The creasing apparatus according to claim 3, comprising an anchor cylinder arranged adjacent to the die cylinder whereby the workpiece is driven through a gap between the anchor cylinder and the die cylinder by counter rotation of the anchor cylinder and the die cylinder.

5. The creasing apparatus according to claim 1, wherein the anchor is held by static forces within the slot.

6. The creasing apparatus according to claim 1, wherein the body portion and head rail portion of the anchor are straight.

7. The creasing apparatus according to claim 1, wherein the body portion and the headrail portion of the anchor are curved.

8. The creasing apparatus according to claim 1, wherein the crease member has a single ridge at a point of impact with the workpiece.

9. The creasing apparatus according to claim 1, wherein the crease member has multiple ridges at a point of impact with the workpiece.

10. A creasing apparatus comprising:

a die mounting board having a slot cut therein;

an anchor having a body portion fixed within the slot, wherein the slot extends throughout a thickness of the die mounting board and the body portion extends through the slot;

a crease member having an upper part for impacting a workpiece and a lower part having a formation shaped to removably engage the anchor, and also having walls extending outward from the lower part and toward the die mounting board, the walls pressed against the die mounting board when the crease member is engaged to the anchor:

wherein the walls are resiliently deflected by force from the die mounting board when the crease member is engaged with the anchor, the crease member held to the anchor by being resiliently held between the anchor and the die mounting board without the use of fasteners between the crease member walls and the die mounting board.

11. The creasing apparatus according to claim 10, wherein the body portion includes gaps and the slot includes discontinuities corresponding in position to the gaps, such that the body portion fits within the slots but not in the discontinuities.

12. The creasing apparatus according to claim 11, wherein the mounting board is in the form of a cylinder and is fit over a die cylinder that is driven in rotation.

13. The creasing apparatus according to claim 12, comprising an anchor cylinder arranged adjacent to the die cylinder whereby the workpiece is driven through a gap between the anchor cylinder and the die cylinder by counter rotation of the anchor cylinder and the die cylinder.

14. The creasing apparatus according to claim 10, wherein the anchor is held by static forces within the slot.

15. The creasing apparatus according to claim 10, wherein the anchor comprises a flat plate shape and the crease member has parallel walls that resiliently clamp the anchor.

16. The creasing apparatus according to claim 10, wherein the anchor comprises a flat plate shape and the crease member has parallel walls with undulating facing surfaces that resiliently clamp the anchor.

17. The creasing apparatus according to claim 10, wherein the crease member has a single ridge at a point of impact with the workpiece.

18. The creasing apparatus according to claim 10, wherein the crease member has multiple ridges at a point of impact with the workpiece.

19. A creasing apparatus comprising:

a die mounting board having a slot cut therein;

an anchor having a body portion fixed within the slot and a head rail portion extending above the mounting board;

wherein the slot extends throughout a thickness of the die mounting board and the body portion extends through the slot;

a crease member having an upper part for impacting a workpiece and a lower part having a formation shaped to removably engage the head rail portion of the anchor, and also having walls extending outward from the lower part and toward the die mounting board, the walls pressed against the die mounting board when the crease member is engaged with the head rail portion, wherein the walls are resiliently deflected by force from the die mounting board when the crease member is engaged with the head rail portion, the crease member held to the anchor by being resiliently held between the head rail portion and the die mounting board without the use of fasteners between the walls of the crease member and the die mounting board.

* * * * *